US006116977A

United States Patent [19]

Tanny et al.

[11] Patent Number: 6,116,977

[45] Date of Patent: Sep. 12, 2000

[54] COLLECTION BOX

[75] Inventors: Chaim T. Tanny, 6375 Mountain Sights, Montreal, Quebec H3W 2Z4, Canada; John Chan, Bridgewater; Lee Shapiro, Fort Lee, both of N.J.

[73] Assignee: Chaim T. Tanny, Montreal, Canada

[21] Appl. No.: 09/182,873

[22] Filed: Oct. 30, 1998

[51] Int. Cl.[7] ..... A45C 1/12; G07B 15/00; A47G 1/06

[52] U.S. Cl. ..... 446/8; 232/10; 40/455

[58] Field of Search ..... 232/10; 40/427, 40/455; 360/12; 369/19; 446/73, 8, 9

[56] References Cited

U.S. PATENT DOCUMENTS

| | | | |
|---|---|---|---|
| 4,670,798 | 6/1987 | Campbell et al. | 360/12 |
| 4,671,455 | 6/1987 | Stockman | 232/1 |
| 5,465,909 | 11/1995 | Roth | 232/10 |
| 5,555,536 | 9/1996 | Rolf et al. | 369/19 |
| 5,795,209 | 8/1998 | Moore | 446/73 |

*Primary Examiner*—Kien T. Nguyen
*Assistant Examiner*—Urszula M. Cegielnik
*Attorney, Agent, or Firm*—Marvin S. Towsend

[57] ABSTRACT

The present invention is directed to a donation container system which includes a sensor for detecting the approach of one or more individuals to the container. The container system also includes a microprocessor and a speaker, so that when the sensor detects the approach of one or more individuals to the container, it sends a signal to the microprocessor which in turn communicates with a voice chip. The voice chip then sends an audio signal to an output speaker so as to produce an audio output.

7 Claims, 2 Drawing Sheets

COLLECTION BOX

BACKGROUND OF THE INVENTION

1. Field of the Invention

The present invention relates to donation containers, which are alternatively referred to as "donation boxes", "charity boxes", or "Tzedakah boxes". In particular, the present invention is related to a donation box capable of emitting an audio response upon detection of the presence of a person passing in the vicinity of the box.

2. Description of the Prior Art

Toy banks are known in the prior art, and are known to have a wide range of constructions and features.

Examples of such banks are illustrated in U.S. Pat. No. 4,079,540 issued to Boyett, III et al. in 1978. In this reference, a toy bank is disclosed for receiving and depositing coins. The system includes a base member, a support member and a coin insertion member. The coin insertion member is moveably mounted with respect to the base member to deposit the coins within the base.

An example of a donation box is illustrated in U.S. Pat. No. 4,671,455, issued to Stockman in 1987. This reference is addressed to the construction of a donation box having a receptacle compartment and a separate merchandise compartment.

U.S. Pat. No. Des. 354,833 issued to Forest in 1995, illustrates the ornamental design of what appears to be a donation container. Donations appear to be collected by the upper container, while confections are dispensed through a slot adjacent the base of the device.

Another coin collecting device is illustrated in U.S. Pat. No. 5,176,238 to Deglau issued in 1993. This patent is addressed to an amusement coin collecting box in which the coins can be observed running through a coin feed slot.

A further coin collecting device is shown in U.S. Pat. No. 5,301942 to Lacrosse issued in 1994. In this patent, the coins are used as part of a game of skill, with the coins dropped through a path containing pins, so as to bounce the coins in different directions. The portion of the device containing the coin path may be watertight, and filled with water to slow the movement of the coins through the coin path.

Another design of a coin collecting box is shown in U.S. Pat. No. Des. 304,644 issued to Silcox in 1989. This reference discloses the ornamental design for a donation box and advertising holder.

However, the prior art does not disclose a donation container which is capable of sensing the presence of people in the vicinity of the container, and activate an audio signal, such as an announcement in response to the detection. In addition, the prior art does not appear to recognize the use of a programmable audio message, which is transmitted in response to the detection of an individual in the vicinity of the donation container. Furthermore, the prior art does not appear to recognize the use of a switch for controlling the activation of the electronics associated with the sensing and signaling activities.

Accordingly, it is an object of the present invention to provide a collection box which is capable of sensing the presence of a person or persons in the vicinity of the container and activate an audio message in response to the detection.

It is another object of the invention to utilize a programmable audio message which is activated in response to the detection of a person or persons.

It is a further object of the present invention to utilize a control switch in a collection box which turns on and shuts off the circuit which activates the sensing function and which transmits the audio signal.

SUMMARY OF THE INVENTION

These objects are achieved by a collection box which emits an audio signal in response to the presence of one or more in the vicinity of the collection box. The box incorporates a sensing means which is capable of detecting changes in the ambient light level or sound level which occur when an individual passes in the vicinity of the light sensor. When a significant light or sound level change is detected by the light sensor, the circuitry sends a signal to a processing means, which in turn communicates with an audio data storage means. This signal then triggers the processing means to communicate with the audio data storage means, and send a signal to a speaker. The audio data storage means is capable of being replaced with alternate audio data storage means so that different messages can be transmitted to the speaker when the sensor means is activated. Examples of such messages are a "Thank You" message, messages which solicit donations, or messages which promote the organization collecting the donations. The system further includes a switch which is capable of turning on and shutting off the sensing means and disabling transmissions to the speaker. This permits a user to optionally eliminate the audio transmissions in situations where the device is being used in a quiet office environment, or to save the battery power which drives the electronic circuit. The switch is also advantageous for cutting off the circuit to comply with certain religious practices. For example, Jewish individuals observing the Sabbath can use the switch to turn off the electronic circuit, so that the donation container complies with the requirements of the Sabbath.

BRIEF DESCRIPTION OF THE DRAWINGS

For a fuller understanding of the nature and objects of the invention, reference should be made to the following detailed description taken in connection with the accompanying drawings, in which.

DETAILED DESCRIPTION OF THE PREFERRED EMBODIMENT

Figure 1:
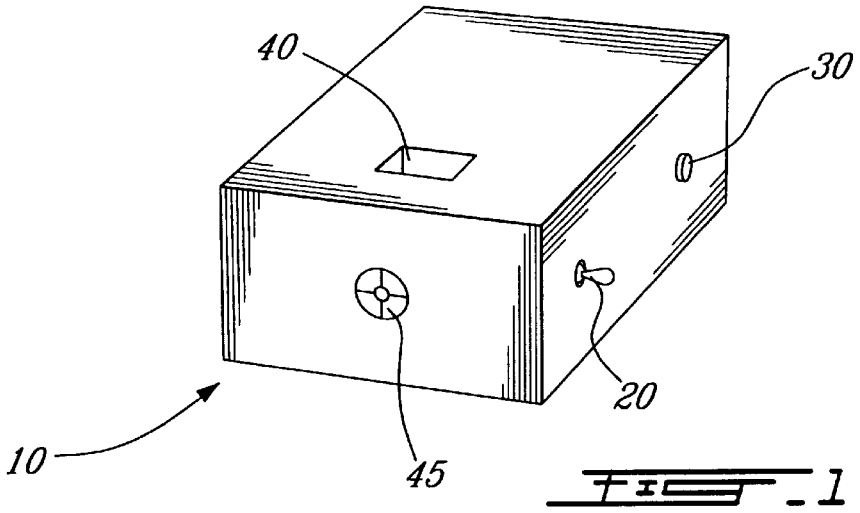
FIG. 1 illustrates a perspective view of the collection box of the present invention.

FIG. 1 illustrates the preferred embodiment of the collection box system 10. The box 10 is illustrated to be of a generally rectangular shape, but may be manufactured in other shapes as would be understood by a person of ordinary skill in the art. The box 10 may also incorporate various indicia, designs, and the like, or may be wrapped in paper including such indicia. The box 10 includes a slot 40 for receiving coin or currency donations and dropping into a coin and currency chamber, and also includes a light sensor 30, a switch 20 and an audio speaker 45. The light sensor may be positioned externally of the box, or may be placed behind an aperture passing through a wall of the box. The locations of these components are only exemplary, and other positions for the slot 40, detector 30, switch 20 and speaker 45 may be incorporated in the present invention. However, the light detector 30 is preferably placed on one of the sides of the box so as to detect changes in incoming light resulting from the approach of individuals to the box.

Figure 2:
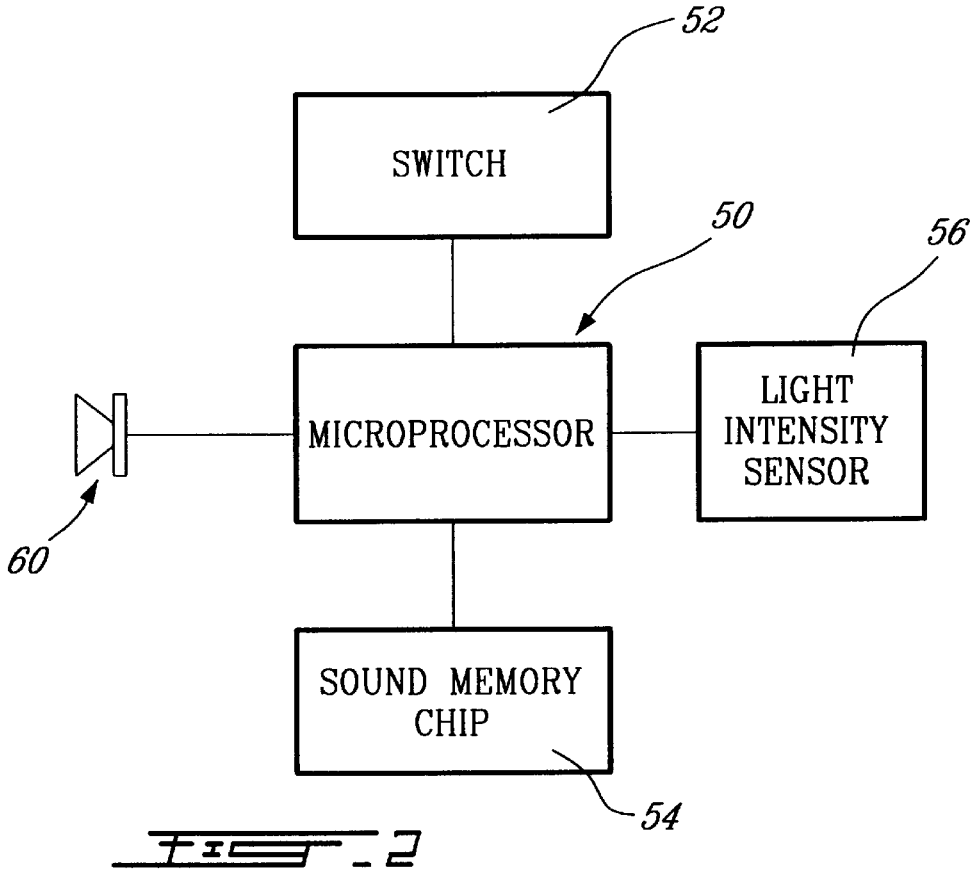
FIG. 2 illustrates a block diagram of the general operating principles associated with the electronic circuit of the present invention.

FIG. 2 illustrates a general schematic representation for the basic electronic components of the box. The electronic circuit includes a processing means, such as a microprocessor 50 which communicates with the switch 52, audio memory means such as a sound memory chip 54 and light intensity sensor 56. The system also includes a loudspeaker 60 which communicates with the microprocessor. The invention is not limited to particular types or brands of these individual components. For example, the switch 52 may be a push-button switch or a pivoting switch, and loud speaker may a radio loud speaker, or a flat speaker of the type commonly used in cellular telephones.

The system of the present invention operates as follows: When the switch 52 is turned on, the microprocessor starts receiving inputs of light intensity data. When the light intensity changes to a certain predetermined degree, the microprocessor 50 communicates with the sound memory chip 54 to send an audio signal to the speaker. The audio signal produces an output in the form of an audio message over the speaker. When the switch is turned off, the microprocessor and light detector are disabled, and the system is shut off.

Although the sound memory chip is fixed in to the circuitry of the system, different sound memory chips containing different messages can be introduced in to the circuit at the point of manufacture. For example, such messages might include a "Thank You" message, or an informative message about the organization responsible for the donation container. The message might also be a solicitation for a donation, music, or combinations of voice messages and music. In addition, the sound memory chip 54 may include memory for a series of different messages, and the microprocessor may be programmed to access different messages at different periods of time, or in a sequential order.

Figure 3:
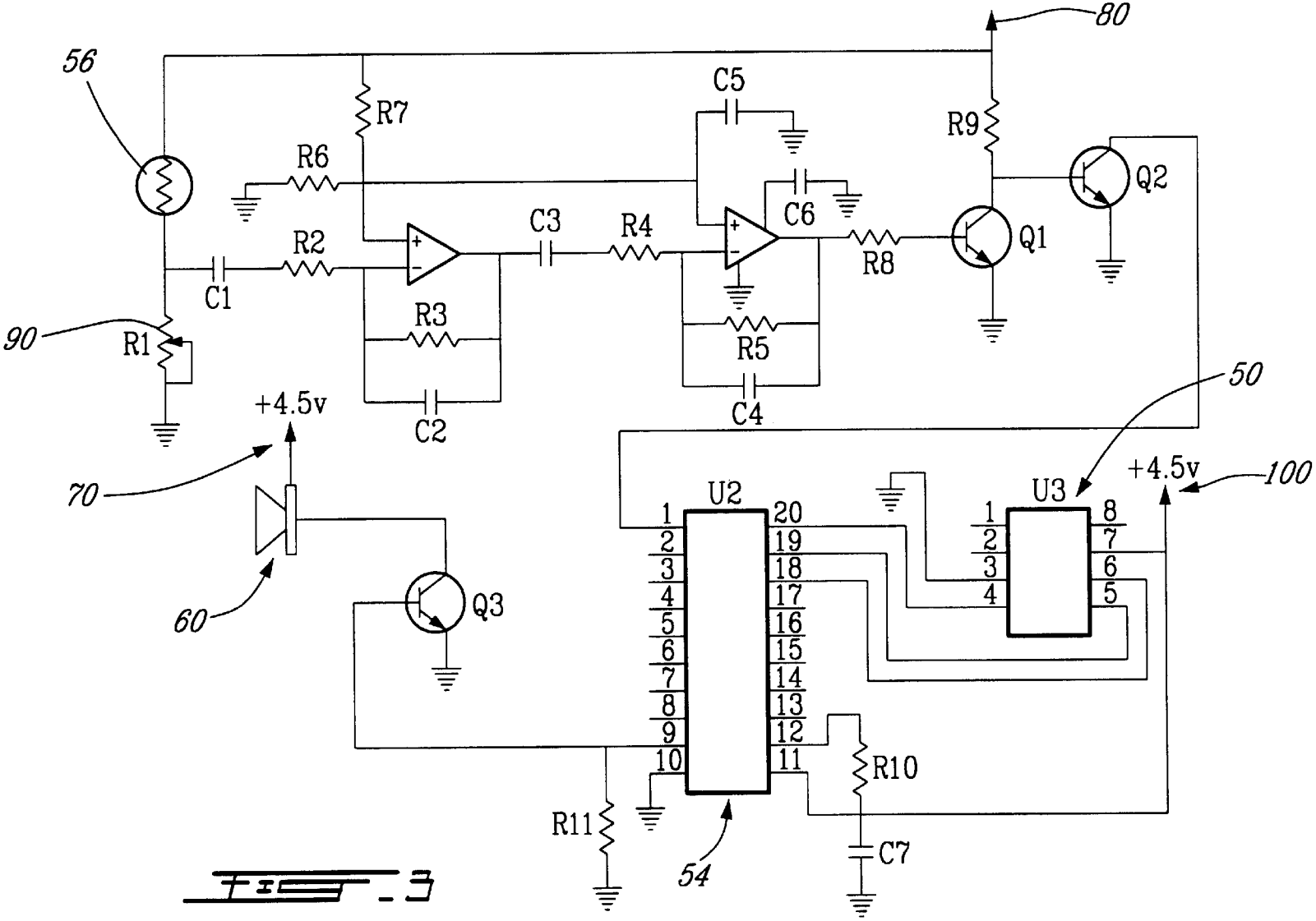
FIG. 3 illustrates a complete circuit diagram as utilized by the present invention.

FIG. 3 illustrates a circuit diagram which may be utilized for the preferred embodiment of the present invention. As shown, the circuit includes a microprocessor 50 as well as the voice chip 54 and speaker 60. The circuit diagram also shows the light sensor 56 as well as a variable resistor 90 which may be advantageously utilized to control the change in light level necessary to trigger the microprocessor to activate the audio chip 50. The circuit is connected to voltage sources at connection points 70, 80 and 100. Although the switch is not shown in this figure, the switch used in the present invention would be interposed between a voltage source, such as a battery, and the connection points 70, 80, and 100.

In an alternate embodiment of the invention, the audio messages to the speaker may be triggered by other sensing means, such as an ultrasonic detector, which is capable of detecting the reflection of an emitted ultrasonic signal. The detection of a reflected signal would activate the microprocessor to send an audio signal to the speaker. Alternatively, the audio message may be triggered by the movement of a mechanical switch, triggered by the drop of coins through the coin slot 40. Such a switch 52 is illustrated in FIG. 2 as communicating with the microprocessor.

While the preferred construction for the donation container is illustrated and described herein, it will be understood that changes in the construction may be made within the scope of the appended claims without departing from the spirit of the invention.

What is claimed is:

1. A self-contained collection box for soliciting and collecting charitable donations in the form of currency and coins, comprising:

the collection box having walls defining a currency and coin collection chamber;

the walls defining a coin slot communicating with the currency and coin chamber and a second opening defined in the walls;

a light sensor in the collection box aligned with the second opening for detecting through the second opening only changes in light intensity that would indicate the presence of individuals in the vicinity of said collection box and for sending a detection signal when an individual has been detected;

a microprocessor in said box, to receive said detection signal;

an audio output device, provided in the box for broadcasting a first audio message;

the microprocessor providing a signal to the audio output device in response to the detection signal whereby an audible first message of solicitation may be broadcast on time for the individual being detected to be within the range of the first message;

detector switch means for detecting currency or coins passing into the collection box through the slot, said microprocessor providing a second audible audio message upon detection of currency or coins.

2. The device as defined in claim 1, and further including indicia on said container.

3. The device as defined in claim 1, and further including a switch in communication with said processing means and detecting means.

4. The device as claimed in claim 1, wherein said microprocessor provides different messages as a function of timer.

5. The device as defined in claim 1, wherein said microprocessor provides different messages according to a sequence.

6. A device as defined in claim 1, wherein the audio output means is a loudspeaker.

7. A device as defined in claim 1 wherein the second audible message is a "thank you".

* * * * *